US006520462B2

(12) United States Patent
Herron

(10) Patent No.: US 6,520,462 B2
(45) Date of Patent: Feb. 18, 2003

(54) TEMPORARY ARM SUPPORT

(75) Inventor: Dean A. Herron, Columbus Grove, OH (US)

(73) Assignee: American Electric Power Company, Inc., Columbus, OH (US)

( * ) Notice: Subject to any disclaimer, the term of this patent is extended or adjusted under 35 U.S.C. 154(b) by 0 days.

(21) Appl. No.: 09/809,864

(22) Filed: Mar. 16, 2001

(65) Prior Publication Data

US 2002/0130232 A1 Sep. 19, 2002

(51) Int. Cl.[7] ..... F16M 13/02
(52) U.S. Cl. ..... 248/218.4; 248/188.2
(58) Field of Search ..... 52/697; 174/45 R, 174/168; 248/218.4, 188.2, 188.4; 269/289 R, 904

(56) References Cited

U.S. PATENT DOCUMENTS

| | | | | | |
|---|---|---|---|---|---|
| 882,835 | A | * | 3/1908 | McGillivray | 248/219.3 |
| 1,181,066 | A | * | 4/1916 | Cornelius | 174/166 R |
| 1,528,268 | A | * | 3/1925 | Schlegel | 182/187 |
| 1,865,134 | A | * | 6/1932 | Plimpton | 248/200 |
| 3,664,624 | A | * | 5/1972 | Freegard | 248/218.4 |
| 4,127,739 | A | | 11/1978 | Farmer | 174/45 R |
| 4,409,907 | A | * | 10/1983 | Norton | 108/152 |
| 4,489,910 | A | | 12/1984 | Ferguson | 248/219.4 |
| 4,695,025 | A | | 9/1987 | Vaughan | 248/293 |
| 4,721,213 | A | | 1/1988 | Eitel | 212/160 |
| 4,728,749 | A | | 3/1988 | Knight | 174/45 R |
| 4,756,130 | A | | 7/1988 | Burtelson | 52/170 |
| 4,932,623 | A | * | 6/1990 | Reisdorff | 248/219.3 |
| 5,174,535 | A | | 12/1992 | Stubbersfield | 248/316.1 |
| 5,228,260 | A | * | 7/1993 | Dziedzic | 403/396 |
| 5,398,478 | A | | 3/1995 | Gordin et al. | 52/742 |
| 5,400,841 | A | | 3/1995 | Holbert | 144/1 A |
| 5,632,461 | A | * | 5/1997 | von Helms et al. | 248/218.4 |
| 5,749,198 | A | | 5/1998 | Johnson | 52/651.04 |
| 5,871,191 | A | * | 2/1999 | Cohn | 108/9 |
| 5,936,825 | A | | 8/1999 | DuPont | 361/127 |
| 5,944,413 | A | | 8/1999 | Crookham et al. | 362/431 |
| 6,012,835 | A | | 1/2000 | Thompson et al. | 364/488 |
| 6,142,434 | A | * | 11/2000 | Trost et al. | 24/270 |
| 6,185,303 | B1 | * | 2/2001 | Losey | 379/454 |
| 6,202,964 | B1 | * | 3/2001 | Thornhill | 248/219.4 |

* cited by examiner

*Primary Examiner*—Leslie A. Braun
*Assistant Examiner*—Ingrid Weinhold
(74) *Attorney, Agent, or Firm*—Standley & Gilcrest LLP

(57) ABSTRACT

A device and method for temporarily supporting and securing the cross-arm of a utility pole during operations that require the cross-arm retaining means to be loosened or removed. One exemplary embodiment of a support device of the present invention comprises an attachment member and a support member. The attachment member may be releasably secured to the upright post portion of the utility pole by means of, for example, a band clamp, or a fastener, such as a lag screw. The support member is designed to engage a portion of the cross-arm and secure it in position. Once secured, the necessary operation may be performed without the risk of the cross-arm tipping or falling. After the performance of the operation, the cross-arm retaining means is tightened or reinstalled, and the support device may be removed from the utility pole.

14 Claims, 2 Drawing Sheets

TEMPORARY ARM SUPPORT

BACKGROUND AND SUMMARY OF THE INVENTION

The present invention relates to a temporary support structure having particular applicability to the maintenance, repair or modification of utility poles. More specifically, the temporary support structure is capable of safely supporting utility pole cross-arms during procedures requiring removal of the retaining means securing the cross-arm to the utility pole.

Utility poles are well known structures commonly used to support cables conducting electrical current. Such utility poles may also be used to support other cables, such as, for example, those providing telephone or cable television services. A utility pole generally consists of an upright wooden post with one end set into the ground, to which may be attached one or more cross-arms. The cross-arms are typically of substantially square or rectangular cross-section and are generally of substantially shorter length than the upright post to which they are attached. The cross-arms are normally located near a top portion of the upright post so that the electrically conducting cables supported thereby do not pose a shock hazard to persons on the ground. The cross-arms may support other equipment such as conductors or insulators. The cross-arms are typically affixed to the upright post with one or more through bolts, and one or more braces may also extend from the upright post to each cross-arm for providing additional support thereto.

Maintenance or repair is often required to be performed on the cross-arms, on devices employed for securing the cross-arms to the upright posts, and on equipment that may be attached to the cross-arms. In addition, other equipment may be added to that already located on the cross-arms, or additional cross-arms may be added to a single upright post. Often, this maintenance, repair and/or modification requires that the retaining means used to secure each cross-arm to the upright post be removed. For example, when workers must replace damaged ridge pins; replace bent through bolts; change damaged cross-arm braces; add current sensor brackets; or mount additional cross-arms, there is a period of time during which the cross-arm cannot remain securely fastened to the upright post. During this time, there is a significant risk that the cross-arm may tip, fall, or otherwise move from its proper position. If not properly secured, cross-arms may shift, for example, because of improper location with respect to the upright post, or from other equipment in contact with the cross-arm upsetting the balance thereof. A tipping, swinging, or falling cross-arm constitutes a risk to workers in the proximity of the cross-arm, as well as to workers on the ground below - due both to injury from the cross-arm itself, as well as injury from contacting energized electrical cables that may be dislodged by the cross-arm.

Current methods for temporarily securing a cross-arm to an upright post during repair, maintenance or modification procedures have proven inadequate. For example, one method commonly employed for supporting cross-arms during such procedures involves driving two screwdrivers into the upright post at a point just below the bottom of the cross-arm. Once the screwdrivers are so located, the cross-arm retaining means may be removed, and the cross-arm allowed to rest on the screwdrivers and against the upright post. However, with this system it is generally uncertain whether the screwdrivers will adequately support the weight of the cross-arm or prevent the cross-arm from becoming dislodged due to, for example, imbalance or contact. Another method also involves removing any energized conductors from the cross-arm in order to reduce the weight thereof and to prevent a tipping or falling cross-arm from damaging live electrical cables. However, this method is very time consuming, and still requires a means of supporting the cross-arm, such as the screwdrivers discussed above. Thus, the current methods and devices used to support a cross-arm during repair, maintenance or modification thereto, may create a danger to workers or others in the area.

Therefore, what is needed and has been heretofore unavailable, is a safe and efficient means of temporarily securing a cross-arm to an upright post of a utility pole. The present invention satisfies this need. The present invention provides a compact, lightweight, support device that is capable of supporting and securing the cross-arm of a utility pole. The support device may be quickly and positively affixed to the upright post of a utility pole, preferably by means of a releasable band clamp.

Preferably, the support device has an attachment member that abuts the upright post of the utility pole, and a support member that supports and secures the cross-arm. The attachment member may be used to mount the handle of the band clamp. The support member preferably includes at least one, and more preferably, at least two adjustable risers that may be adjusted against the bottom of the cross-arm once the support device has been secured to the upright post. The risers allow force to be exerted against the bottom of the cross-arm so that the cross-arm retaining means may be removed without the weight of the cross-arm bearing down thereon.

The support device may be constructed from a plurality of materials, such as, for example, metal, plastic or wood. Preferably, however, the support device is constructed from aluminum. It has been found that aluminum provides adequate strength, at a weight significantly less than that of steel. The support device may be constructed by, for example, welding together an aluminum channel and an aluminum angle to form the attachment member and support member, respectively. If constructed of a plastic material, the support device may be a molded, unitary structure.

Thus, the present invention provides a safe and efficient device and method for supporting and securing the cross-arm of a utility pole during operations that require the loosening or temporary removal of the cross-arm retaining means. The compact, lightweight design of the support device of the present invention allows the device to be conveniently transported and used by a single worker if necessary.

BRIEF DESCRIPTION OF THE DRAWINGS

In addition to the novel features and advantages mentioned above, other objects and advantages of the present invention will be readily apparent from the following descriptions of the drawings and exemplary embodiments, wherein like reference numerals across the several views refer to identical or equivalent features, and wherein.

DETAILED DESCRIPTION OF THE EXEMPLARY EMBODIMENT(S)

Figure 2:
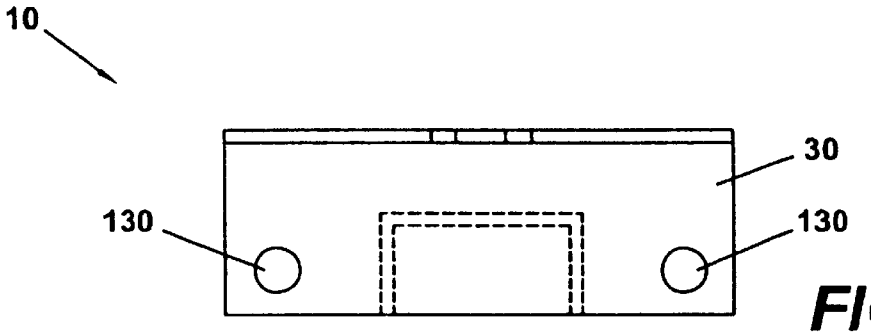
FIG. 2 is a top view of the support device of FIG. 1.
Figure 1:
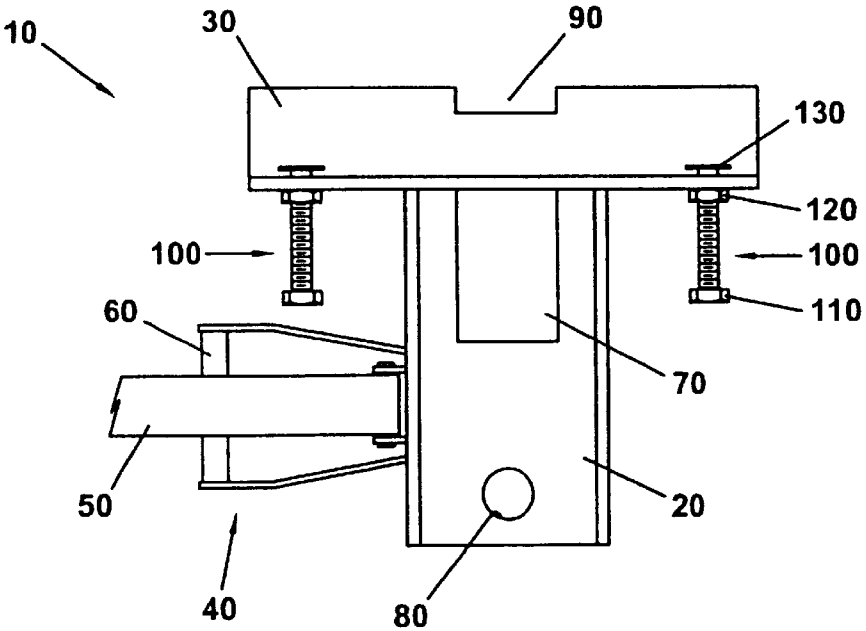
FIG. 1 is a front view of an exemplary embodiment of a support device of the present invention.
Figure 3:
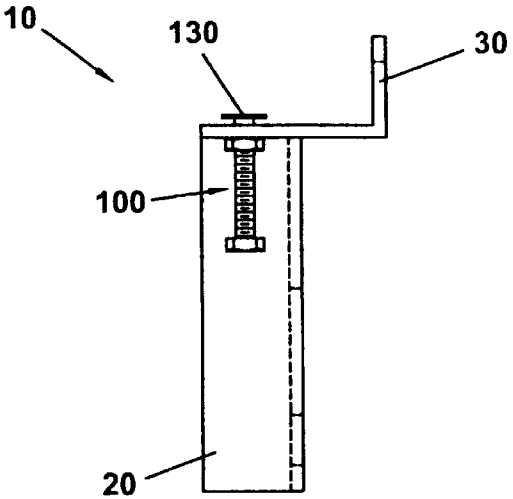
FIG. 3 is side view of the support device of FIG. 1.

An exemplary embodiment of a cross-arm support device 10 of the present invention may be seen in FIGS. 1–3. In this embodiment, the cross-arm support device 10 can be seen to have an attachment member 20 for releasable attachment to an upright post of a utility pole, and a support member 30 for engaging and supporting a cross-arm attached to the upright post. Preferably, the support member 30 is of a sufficient length to prevent any tipping of the cross-arm while the cross-arm is supported by the cross-arm support device 10. Each of the attachment member 20 and support member are preferably manufactured from aluminum, although other metallic and non-metallic materials may also be acceptably used. More specifically, as shown in FIGS. 1–3, the attachment member 20 may be formed from an aluminum channel, while the support member 30 may be comprised of an aluminum angle. In this embodiment, the attachment member 20 and support member 30 may be joined, for example, by welding.

Although not shown in FIGS. 1–3, it may also be possible to notch the top portion of the attachment member 20, so that the attachment member may engage the cross-arm without the need for a separate support member 30. In this case, the dimensions of the attachment member 20 must be such that the attachment member is able to capture and balance the cross-arm.

A means for securing the cross-arm support device 10 to a utility pole may be affixed to the attachment member 20 or, alternatively, may be carried as a separate item and placed in communication with the cross-arm support device and utility pole. In the particular embodiment of the cross-arm support device 10 shown in FIGS. 1–3, a band clamp 40 is affixed to the attachment member 20 such that the strap portion 50 thereof may be wrapped around both the attachment member and the upright post of a utility pole (see FIG. 4), and secured by tightening with the band clamp handle 60. It should be noted that although visible in FIG. 1, for purposes of clarity, the band clamp has been omitted from FIGS. 2–3. Other means for releasably attaching the cross-arm securing device 10 to a utility pole may also be employed, including, for example, other types of clamps, lag screws, bolts, or other similar fasteners.

An aperture 70 may be provided in the attachment member 20 to further reduce the weight of the cross-arm support device 10. The aperture 70 may further act as a handle for allowing easier grasping and carrying of the cross-arm support device 10. A hole 80 may also be provided in the attachment member 20 to allow for the passage of a lag screw, bolt, or similar fastener. Such a fastener may be used to releasably secure the cross-arm support device 10 to a utility pole having a cross-arm of a weight that may not be safely secured by means of the band clamp 40. A notch 90 may also be provided in the support member 30 to allow access to a through bolt (see FIG. 4) or other cross-arm retaining means once the cross-arm support device 10 has been attached to the utility pole.

Preferably, there is at least one, and more preferably, two or more adjustable risers 100 attached to the support member 30 of the cross-arm support device 10. The risers 100 may be substantially comprised of a bolt 110 passing upward through the support member 30, although other raising means may also be employed. Depending on the material used to construct the cross-arm support device 10, a nut 120 may be welded or otherwise affixed to the bottom side of the support member 30 to allow the bolt 110 to thread upward and downward therethrough. Alternatively, the support member 30 may be tapped to provide threads for the bolt 110, and a nut 120 may be tightened against the support member to secure the riser 100 position once the riser is sufficiently adjusted against the cross-arm. A washer 130 or other substantially flat element is also preferably attached to the end of the bolt 110 that will contact the cross-arm. Preferably, the washer 130 has a diameter greater than that of the bolt 110, in order to prevent the riser 100 from becoming dislodged from the support member 30, and to better distribute the force of the bolt on the cross-arm. Although not shown, if the attachment member is notched as described above, such that no support member is required, adjustable risers may be attached, for example, to the sides of the attachment member.

Figure 4:
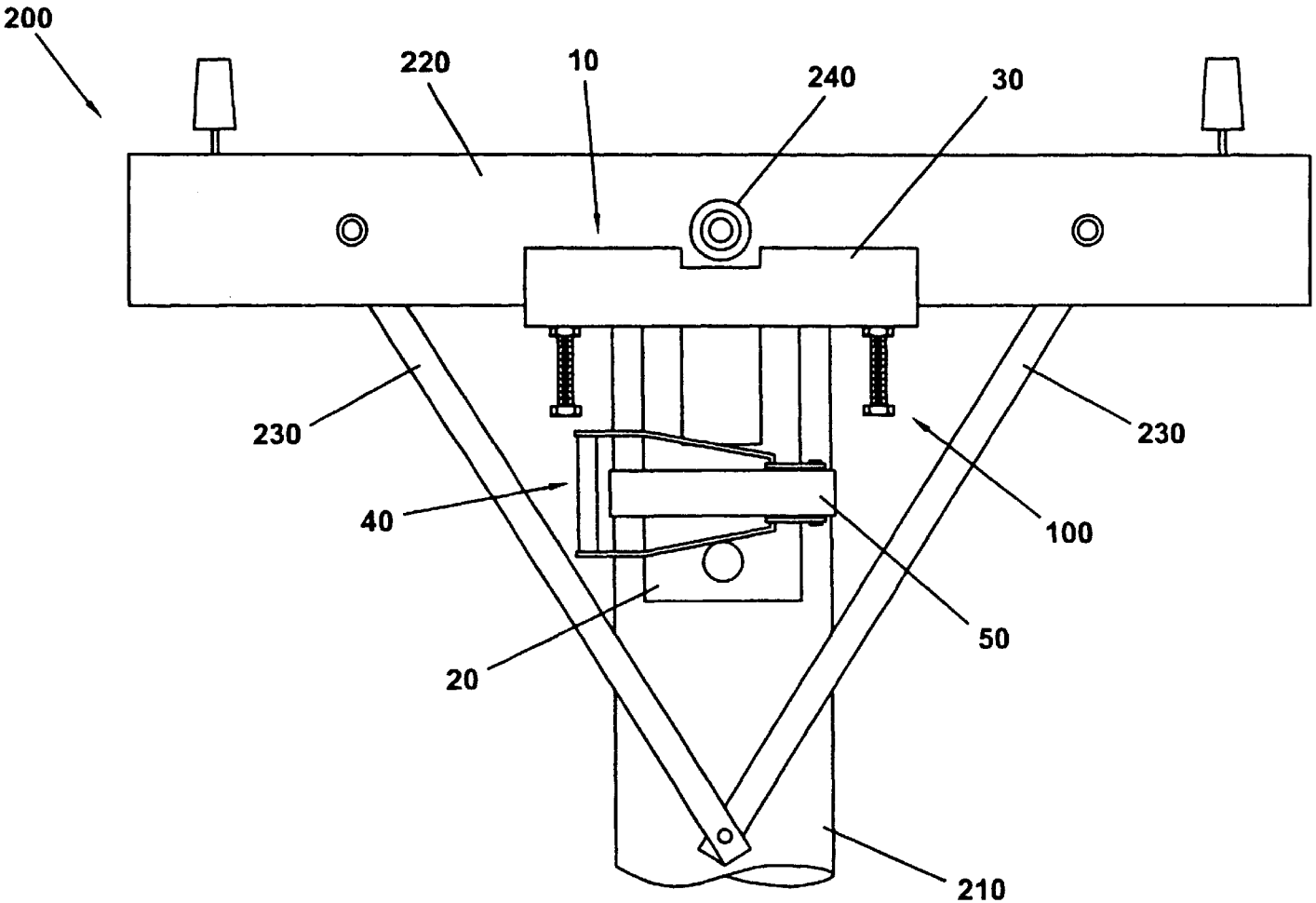
FIG. 4 shows the support device of FIG. 1 secured to the upright post of a utility pole in order to support a cross-arm located thereon.

Referring now to FIG. 4, the exemplary embodiment of the cross-arm support device 10 described above and illustrated in FIGS. 1–3, is shown releasably secured to a utility pole 200. The utility pole 200 can be seen to have an upright post 210 that anchors the utility pole to the ground and also supports a cross-arm 220. Braces 230, anchored at one end to the upright post 210, are provided to further support the cross-arm 220.

To use the cross-arm support device 10 of the present invention, a worker preferably first ensures that the risers 100 are substantially retracted against the support member 30, thereby affording a maximum amount of adjustment thereof once the cross-arm support device is attached to the utility pole 200. The attachment member 20 and support member 30 are then preferably aligned with the upright post 210 and cross-arm 220, respectively. The cross-arm support device 10 is preferably aligned so that the notch 90 provided in the support member 30 allows access to the through bolt 240 or other retaining means securing the cross-arm 220 to the upright post 210. The strap portion 50 of the band clamp 40 is then wrapped around both the attachment member 20 portion of the cross-arm support device 10 and the upright post 210 of the utility pole 200, and secured with the clamp handle 60. As discussed above, when working on a heavy cross-arm 220, the cross-arm may be releasably secured to the upright post 210 with a lag screw, bolt, or similar fastener using the hole 80 provided in the attachment member 20. In such a case, the lag screw, bolt, or other fastener may be used alone, or in conjunction with the band clamp 40.

After being secured to the upright post 210, the risers 100 are preferably adjusted to provide an upward force on the cross-arm 220. Providing an upward force on the cross-arm 220 allows the weight of the cross-arm to be substantially removed from the through bolt 240 or other cross-arm retaining means, thereby facilitating the removal thereof.

After removal of the through bolt 240 or other cross-arm retaining means, the cross-arm support device 10 will securely maintain the position of the cross-arm 220 to the upright post 210. The necessary repairs, maintenance, or modifications may then be made without the danger of the cross-arm 220 tipping or falling from upright post 210. Upon completion of the necessary repairs, maintenance, or modifications to the cross-arm 220 or cross-arm-related equipment, the through bolt 240 or other cross-arm retaining means may be tightened or reinstalled, and the cross-arm support device 10 removed from the utility pole 200.

Therefore, it can be seen from the foregoing that the present invention provides a safe and efficient device and method for securely supporting a cross-arm of a utility pole during maintenance, repair, modification or other operations that require the loosening or removal of the cross-arm retaining means. The device and method of the present invention is superior to previous methods used during such operations, and significantly improves worker safety. For purposes of illustration and not limitation, certain exemplary embodiments of the present invention have been described in detail above. However, it should be realized that the scope of the invention is not to be considered limited by such disclosure, and modifications are possible without departing from the spirit of the invention as evidenced by the following claims:

What is claimed is:

1. A temporary support device for a utility pole cross-arm, said support device comprising:

an attachment member adapted to engage an upright post portion of a utility pole;

a support member having its length oriented substantially perpendicular to that of said attachment member, said support member having both a horizontal and vertical leg extending substantially along the length thereof, said horizontal and vertical legs joined at a substantially right angle and positioned to engage said cross-arm substantially along a lower, longitudinal edge thereof, said vertical leg further designed to allow access to a cross-arm retaining means after said support device is secured to said upright post;

a releasable securing device for releasably affixing said attachment member to said upright post; and one or more adjustable risers connected to said support member, said adjustable risers adapted to produce an upward force against the bottom of said cross-arm after said attachment member has been releasably affixed to said upright post;

wherein said support device is able to temporarily support said cross-arm on said upright post for a period of time during which said cross-arm is not secured to said upright post by said cross-arm retaining means; and wherein said support device is removed from said utility pole after said cross-arm is secured to said upright post.

2. The utility pole cross-arm support device of claim 1, wherein said attachment member and said support member are constructed of metal.

3. The utility pole cross-arm support device of claim 2, wherein said metal is aluminum.

4. The utility pole cross-arm support device of claim 1, wherein said releasable securing device is a clamp, said clamp having a strap for wrapping around both of said attachment member and said upright post.

5. The utility pole cross-arm support device of claim 4, wherein said clamp is attached to said attachment member.

6. The utility pole cross-arm support device of claim 1, further comprising a hole in said attachment member for allowing the passage of a fastener used to secure said attachment member to said upright post.

7. A method of temporarily supporting a utility pole cross-arm, said method comprising:

providing a support device for securing said cross-arm, said support device having an attachment member for engaging an upright post of said utility pole, and a support member for engaging and capturing at least a portion of said cross-arm;

releasably securing said support device to said upright post of said utility pole;

adjusting one or more adjustable risers provided on said support device to apply an upward force on said cross-arm;

loosening or removing a cross-arm retaining means that secures said cross-arm to said upright post;

performing one or more required operations on said cross-arm, or elements involving said cross-arm;

tightening or reinstalling said cross-arm retaining means; and releasing said support device from said upright post.

8. The method of claim 7, further comprising substantially retracting said one or more adjustable risers prior to securing said support device to said upright post of said utility pole.

9. The method of claim 7, wherein said support device is secured to said upright post by means of a clamp, said clamp having a strap portion that wraps around both of said attachment member and said upright post.

10. The method of claim 9, wherein said clamp is affixed to said attachment member.

11. The method of claim 7, wherein said support device is secured to said upright post by inserting a fastener through a hole in said attachment member and into said upright post.

12. The method of claim 11, wherein said fastener is used in conjunction with a clamp to secure said attachment member to said upright post.

13. A support device for releasably securing the cross-arm of a utility pole, said support device comprising:

an attachment member adapted to engage an upright post portion of said utility pole;

a support member connected to said attachment member, said support member adapted to engage a portion of said cross-arm and having at least one notch for allowing access to a cross-arm retaining means after said support device is secured to said upright post; and a releasable securing device for releasably affixing said attachment member to said upright post;

wherein said support device is able to securely support said cross-arm on said upright post after said cross-arm retaining means is released or removed from said cross-arm.

14. A utility pole cross-arm support device, said support device comprising:

an attachment member adapted to engage an upright post portion of a utility pole;

a support member having its length oriented substantially perpendicular to that of said attachment member, said support member having both a horizontal and vertical leg extending substantially along the length thereof, said horizontal and vertical legs joined at a substantially right angle and positioned to engage said cross-arm substantially along a lower, longitudinal edge thereof, said support member further having at least one notch for allowing access to a cross-arm retaining means after said support device is secured to said upright post;

a releasable securing device for releasably affixing said attachment member to said upright post; and one or more adjustable risers connected to said support member, said adjustable risers adapted to produce an upward force against the bottom of said cross-arm after said attachment member has been releasably affixed to said upright post;

wherein said support device is able to securely support said cross-arm on said upright post after said cross-arm retaining means is released or removed from said cross-arm.

* * * * *